US006766794B1

(12) United States Patent
Bently

(10) Patent No.: US 6,766,794 B1
(45) Date of Patent: Jul. 27, 2004

(54) DEVICE FOR HANDS-FREE FIRING OF PROJECTILE DEVICE

(76) Inventor: Samuel Bayne Bently, 80 S. Market St., 2nd Floor, San Jose, CA (US) 95113

( * ) Notice: Subject to any disclaimer, the term of this patent is extended or adjusted under 35 U.S.C. 154(b) by 0 days.

(21) Appl. No.: 10/425,212

(22) Filed: Apr. 28, 2003

(51) Int. Cl.[7] ..... F41B 5/18
(52) U.S. Cl. ..... 124/35.2; 124/32; 124/34
(58) Field of Search ..... 124/32, 34, 35.2

(56) References Cited

U.S. PATENT DOCUMENTS 3,770,981 A * 11/1973 Nelsen
5,243,957 A 9/1993 Neilson ..... 124/88
5,494,023 A * 2/1996 Kolak
5,575,269 A 11/1996 Harklau ..... 124/35.2
5,765,536 A 6/1998 Scott ..... 124/35.2
5,850,825 A 12/1998 Scott ..... 124/35.2
6,606,984 B2 * 8/2003 Mugg

* cited by examiner

*Primary Examiner*—John A. Ricci
(74) *Attorney, Agent, or Firm*—Thomas Schneck; David M. Schneck

(57) ABSTRACT

A device to aid in firing a projectile firing device is disclosed. The device includes a hands-free switch which signals a firing mechanism to fire the projectile firing device.

14 Claims, 5 Drawing Sheets

DEVICE FOR HANDS-FREE FIRING OF PROJECTILE DEVICE

TECHNICAL FIELD

The present invention relates to the firing of projectile devices and specifically to electronic means for firing such devices.

BACKGROUND OF THE INVENTION

Archery, for both hunting and target practice remains a popular pastime and competitive sport. New developments in the past few decades have added increased appeal to the sport. For example, compound bows allow additional power for shooting.

Traditionally the archer would draw the bowstring by the fingers. The difficulty of releasing the string in a uniform manner has lead to the development of a wide variety of release aids. The objective of such release aids is to achieve uniform release of the bowstring and to relieve the tension on the fingers that results in fatigue and even long term injury to the fingers.

Such release aids typically have a jaw at the end of the aid that closes over the bowstring and holds it securely during the draw and aim. A trigger links to the jaw so that actuation of the trigger by the archer's finger or thumb opens the jaw and releases the string. The release aid disclosed in Scott, U.S. Pat. Nos. 5,850,825 and 5,765,536 is typical of such release aids.

With the removal of the inconsistencies of string release, some of the variables in drawing and releasing the bowstring are minimized, with a consequent improvement of accuracy of shooting.

The progress in evolution of release aids has been toward ever more sensitive trigger action, to the point at which no discernible motion of the trigger occurs to achieve release. Only a slight finger or thumb pressure is required to actuate a pre-cocked trigger action.

U.S. Pat. No. 5,575,269 discloses the introduction of a delayed electrical signal upon triggering the device, which subsequently actuates the release. The objective in that case is to introduce a time delay that would overcome the natural anticipatory flinching occurring upon pulling the trigger. The means for actuating the release is a finger actuated trigger.

A second electrical variation is disclosed in U.S. Pat. No. 5,243,957, in which a shoulder and waist harness hold the bowstring retainer at a fixed distance from the archer's face, and hand grips attached to the riser of the bow (i.e., the body of the bow holding 2 flexing limbs) permit the imparting of tension (drawing) to the bow by pressing forward with both hands. This patent proposes to effect release of the bowstring by means of an electrical switch actuated by one finger, which closes an electrical circuit to some actuating device that releases the string. Here too the actuating device is not described further than reference to it as a solenoid.

In even the most advanced of these designs, there is still required muscle action of the fingers or thumb of the same hand that is striving to acquire and maintain aim on the target. This distracts from the steadiness of hold on the target and is familiar to every archer as deflection, or flinching at the moment of release, with consequent degradation of accuracy of the shot.

SUMMARY OF THE INVENTION

The objects are achieved through an apparatus in which a projectile firing device is actuated using a hands free actuation device. Because the hands of the device user do not trigger the firing of the device, improved aim of the projectile firing device is obtained.

In one embodiment, this device is part of a projectile firing device having a firing mechanism. The device includes a hands-free switch that is activated by the user to send a signal. This signal is received by a firing mechanism, which than automatically fires a projectile device.

In one embodiment, this device is an apparatus for release of a bowstring. The device includes a jaw configured to hold a bowstring. The jaw is mechanically linked to a trigger such that actuation of the trigger opens the jaw, releasing the bowstring. A motor is mechanically linked to the jaw trigger (by a trip lever, wind-up spindle, or other linking means), such that activation of the motor actuates the trigger, opening the jaw and releasing the bowstring. A hands-free actuator (i.e. an actuator which is operated by the user of a projectile firing device without use of this persons hands or arms) is linked to the motor such that a signal is sent to the motor to activate the motor.

In one embodiment, this actuator is a bite-activated switch held in the archer's mouth. The archer may bite down on the switch, making an electrical connection that activates the motor. Wires to the motor, providing a device that is relatively small and simple to manufacture, may directly link this bite-activated switch.

BEST MODE FOR CARRYING OUT THE INVENTION

The present invention allows for an operator of a projectile firing device to fire the device without using the operator's hands. For the purposes of the present invention, a projectile firing device is a device which fires a projectile, is manually transported by the operator and normally discharged using the operator's hands. A hands-free switch, trigger or actuator is any switch that is fired by a method other than use of the operator's hands.

In one embodiment this invention allows the actuation of a bowstring release by biting on an electrical contact switch held between the teeth while drawing the bow. The purpose of such a device is to avoid the small disturbances to the shooter's aim associated with the act of pulling the trigger of a conventional mechanical release aid.

In one embodiment of the invention, the device may include both a hands-free switch and a hand activated electronic microswitch. The user could choose either switch to activate the release device.

Figure 1:
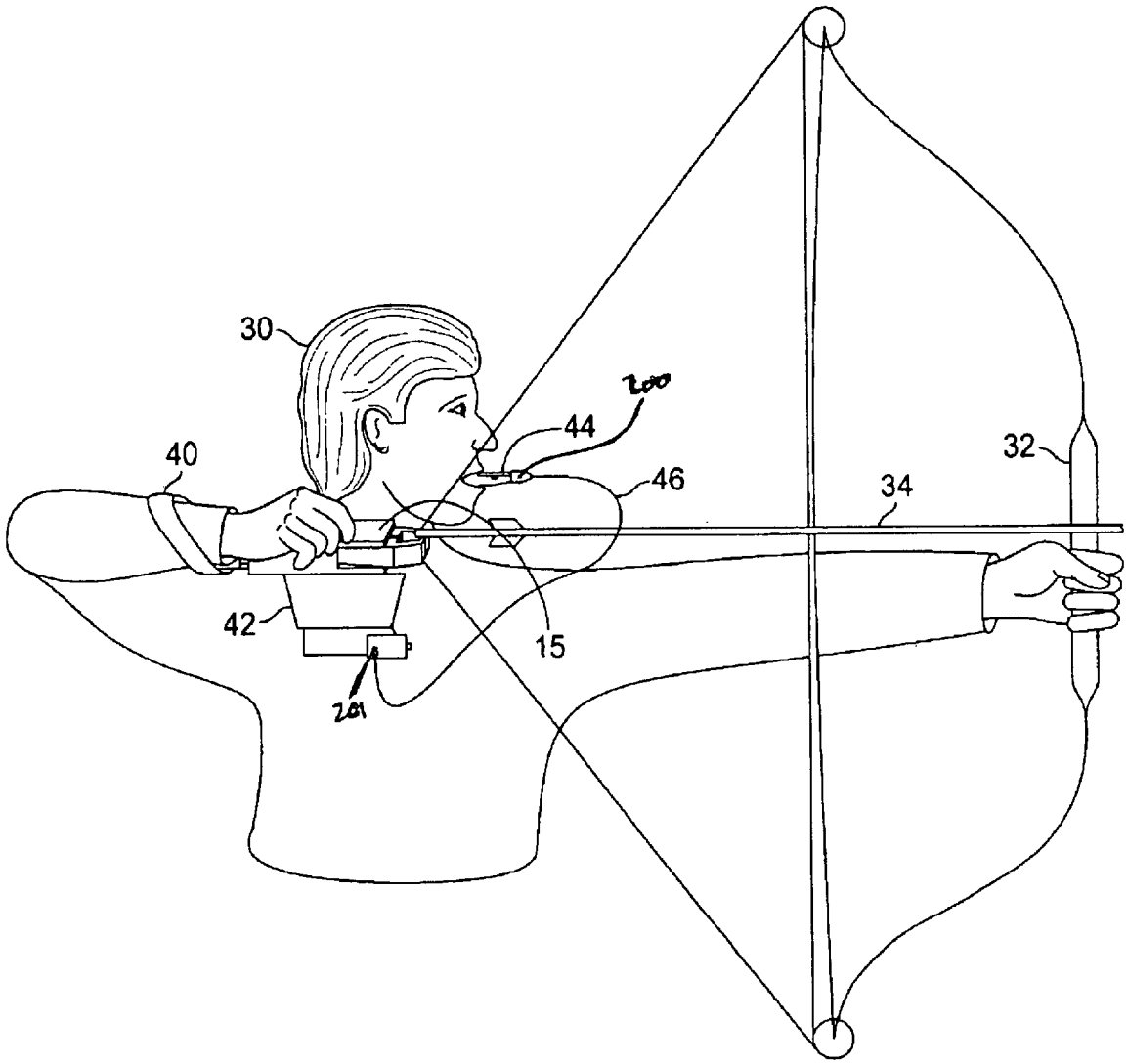
FIG. 1 is a side view of a bow fired by one embodiment of the present invention.

With reference to FIG. 1, an archer 30 holds a compound bow 32. The archer 30 has a bowstring release device 42 held on the wrist of the firing arm by straps 40. Bowstring release device 42 includes a pair of jaws which may open to release bowstring 36, firing arrow 34. A bite contact switch 44 is held in the archer's mouth. When the archer wants to release the bowstring, the archer bites down on bite contact switch 44, sending a signal through wire 46 to bowstring release device 42. This activates device 42, opening the jaws 15 and releasing the bowstring.

In the present detailed illustration, the invention is adapted to use a commercially available bowstring release device. Such a device would include a wrist strap, a shaft, a pair of jaws at the end of the shaft and a hand-activated trigger for opening the jaw. One example is sold as "The Caliper", sold by Scott Archery Company. The release aid disclosed in U.S. Pat. Nos. 5,850,825 and 5,765,536 is of a type suitable for the present invention.

The present embodiment of the invention modifies this device by adding electrical actuation of the jaw trigger. This modified device requires mounting a small 4.5 volt electric hobby motor with a 25:1 gear reduction unit and an additional 3:2 gear box having a free idler gear acting as a clutch mechanism to the underside of the release.

Figure 2:
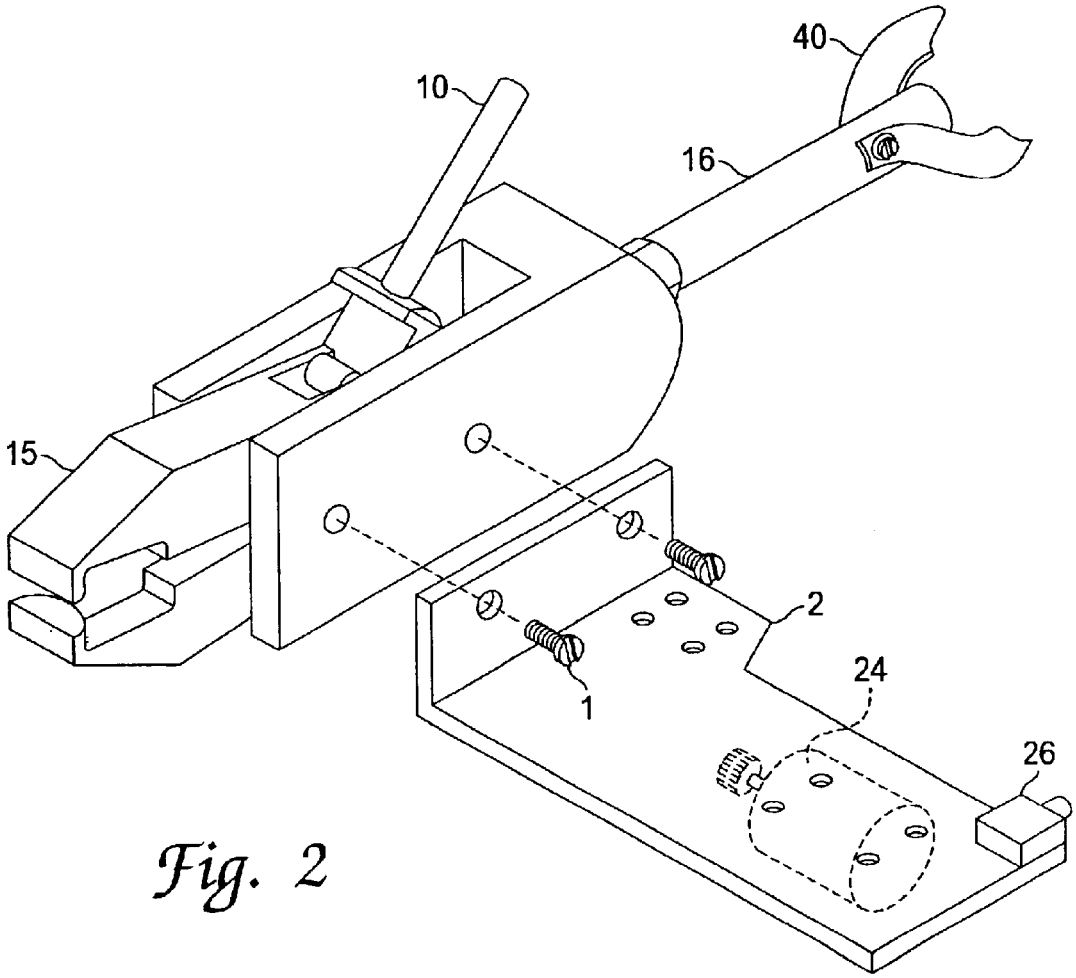
FIG. 2 is perspective view of the jaw, mounting and motor portions of the projectile firing device shown in FIG. 1.

The motor and reduction gear unit used in this example employ a 25:1, 2-stage planetary gear unit having the output shaft collinear with the motor shaft. With respect to FIG. 2, the commercially available bowstring release device is shown having wrist straps 40, which allow the device to be secured to the archer's wrist. The shank 16 of the release device extends along the archer's wrist. Jaws 15 of this device may open to release a bowstring. The jaws are opened by pulling trigger 10. This gives a smooth and even release. However, additional advantages in shooting would be achieved through some mechanism where trigger 10 could be pulled without using the archer's hands. This is achieved by the instant invention.

Attached to the commercially available release device is a mounting plate 2 attached to the underside of the base release by two screws 1 into tapped holes in the release. The motor 24 is suspended below the release so that its shaft is perpendicular to the axis of the release, and with the shaft nearly inline, but slightly forward of the pivot point of the release trigger. A main drive spur gear, a 12 tooth aluminum gear, is attached to the drive shaft by means of a small set screw.

Figure 3:
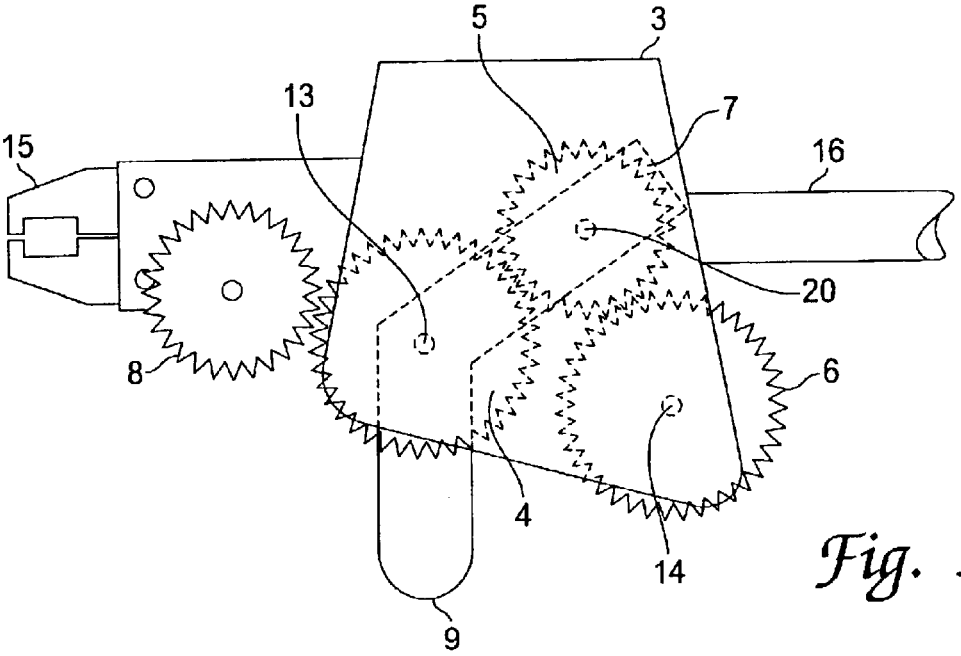
FIG. 3 is a partial side view of the gear box assembly of the device used in FIG. 1.

With respect to FIG. 3, the transfer and clutch gearbox are shown. A separate gearbox consists of 3 aluminum spur gears having their pitch match that of the main drive gear, but with 18, 15, and 18 teeth, respectively, so that the final additional gear reduction, beyond the motor output shaft is 18:12, that is, a 3:2 ratio.

This gearbox is similarly mounted on the mounting plate just behind the motor and positioned so that its first gear (a 18 tooth gear) engages in a fixed arrangement the motor drive gear. The second gear (the 15 tooth gear) of the transfer gearbox is an idler gear mounted in free rotation on a bracket which pivots on the axis of the first gear in such a way that it remains in constant fixed engagement with the first gear, but is free to pivot around the first gear.

The action of the release device is best described by reference to FIG. 3, describing the gearbox assembly. The gear box housing (GBH) 3 is a U-shaped channel in which the "bottom" of the "U" contains 4 holes for mounting screws that attach the gear box to the mounting plate 2 shown in FIG. 2. The GBH 3 carries two axles, for the first transfer gear 4 and for the third transfer gear 6.

Axle 13 for the first transfer gear 4 is a ⅛ inch brass tube or rod soldered at both ends to the upper and lower plates of the GBH 3. The first transfer gear 4 rotates freely on this axle.

The axle 14 for the third transfer gear 6 turns in styrene bushings glued to the upper and lower plates of the GBH 3. The third transfer gear 6 is locked to this axle 14 by a set screw in the gear 6. This axle 14 is also the wind-up spindle, as it extends about 1 inch about the GBH 3.

The second transfer gear 5 is an idler gear that makes the linkage between the first transfer gear 4 and the third transfer gear 6. This second transfer gear rotates on a shaft affixed to the idler carrier bracket 7, which is another "U" shaped channel moving within the GBH 3. The end of the bracket represented by the "bottom" of the "U" is the one near which axle 20 is fixed. This axle is also a brass tube or rod soldered to the bracket 7 at its two ends, and the second transfer gear 5 rotates freely on this axle.

The axles 13, 20 of the first and second transfer gears 4 and 5 are so positioned as to maintain fixed engagement of these two gears. The idler carrier bracket 7 at its open end is bored with ⅛ inch holes through which passes the same axle as that for the first transfer gear 4. Thus, the idler carrier bracket 7 and the idler gear 5 pivot around axle 13, while maintaining engagement of the first and second transfer gears 4 and 5.

The first transfer gear 4 is thus within the two arms of the idler carrier bracket 7, and furthermore, there is a small compression spring on the axle 13 between gear 4 and the bracket 7 which ensures a small amount of rotational friction between gear 4 and bracket 7, which yields a tendency of bracket 7 to rotate in the same sense as gear 4, for a limited arc of travel, while not rigidly constrained to do so.

The bracket 7 can therefore swing in a limited arc between stops imposed by the gear box housing 3 and the position of full engagement of the second and third transfer gears 5, 6.

It is this movement of the bracket 7 carrying the idler gear 5 that provides clutch action between the motor gear 8 and the wind-up spindle 14, since it engages these two gears at one limit of its range of movement and disengages these two gears at the opposite limit of its range of movement.

Figure 4:
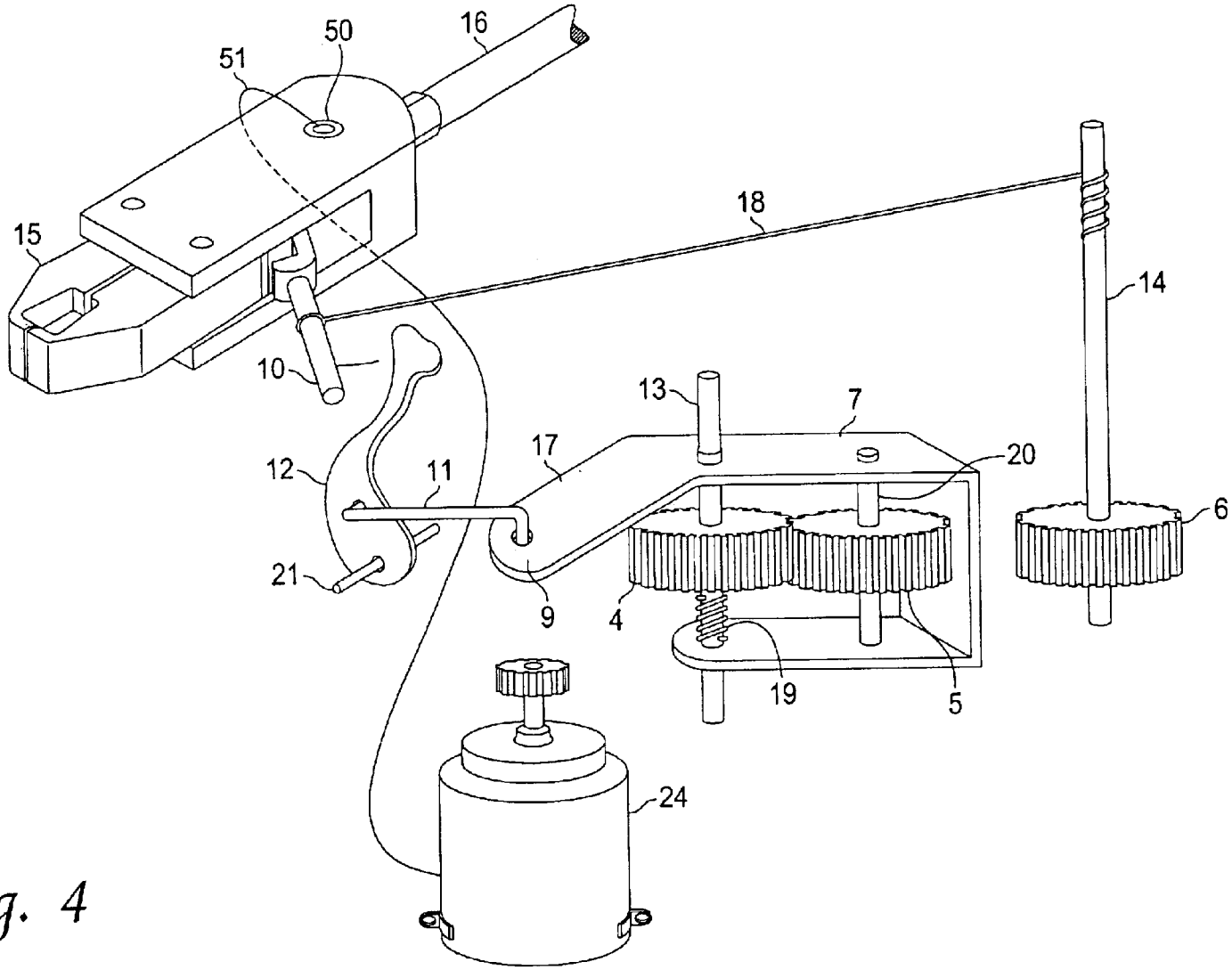
FIG. 4 is a perspective view of the disassembled gear elements of the firing device shown in FIG. 1.

To follow the action of the trigger release, consider the initial state of the gears to be disengaged, that is, in FIG. 4, the idler carrier bracket 7 is at its counter-clockwise rotational limit. The motor gear 8 is to rotate counterclockwise upon closing of its electrical circuit, the means of which will be discussed below.

Counterclockwise rotation of motor gear 8 causes the first transfer gear 4 to rotate clockwise, and because of the small frictional coupling between gear 4 and the bracket 7, the latter is caused to pivot about axle 13, carrying with it the second transfer gear 5 to the point of engagement with the third transfer gear 6. As soon as contact occurs between the second and third transfer gears 5, 6 the resistance of the latter brings about a tighter engagement and thus the gear 6, and with it the wind-up spindle 14, are impelled to turn in a clockwise direction.

In FIG. 4, the upper end of the spindle has a cord 18 (of Kevlar string or other durable material) affixed to it so that when it winds up it exerts a pull at its opposite end, by which the trigger, being attached to the cord, is tripped.

After being tripped, it is necessary to provide for an immediate disengagement of the wind-up spindle 14 and the third transfer gear 6 so that the gears do not bind up, as such binding would continue to exert tension on the cord. The disengagement is provided by a disengagement arm 12 that pivots in a vertical plane, (FIG. 3 shows a horizontal planar view). Namely, near the end of its travel the trigger 10 contacts the upper end of the disengagement arm 12, causing it to move rightward. The arm 12 has additionally a rigid wire link 11 connecting it to the extended tab 9 on the idler carrier bracket 7. The rightward motion of the arm 12 then communicates a counterclockwise swinging motion to the bracket 7, which causes the gears 5 and 6 to disengage once more. By a proper adjustment of the length of the link wire 11, and the shape of the upper portion of the disengagement arm 12, the timing can be achieved by which the disengagement occurs exactly at the end of travel of the tripped trigger 10.

FIG. 4 shows the idler carrier bracket 7 with its two gears, (the first and second transfer gears 5, 6), in perspective, in which the shape of the disengagement arm 12 and the position of the link wire 11 show more clearly. The items are shown in a partially exploded view. Motor 24 turns gear 4, turning gear 5, rotating gear 6 to trip trigger 10.

The third transfer gear 6 and the wind-up spindle are shown. The components shown in FIG. 4, except for the idler carrier itself, are not shown in realistic scale, the adjacency of the motor, disengagement arm and wind-up spindle, for example, being distorted.

In FIG. 4 the gearbox housing is omitted, for clarity. It serves to carry the axles 13 and 14 of the first and third transfer gears 4, 6. This housing surrounds the idler carrier bracket 7 and is attached to the mounting plate 2 of FIG. 2, at the position of the gearbox mounting holes shown in FIG. 2.

Figure 5:
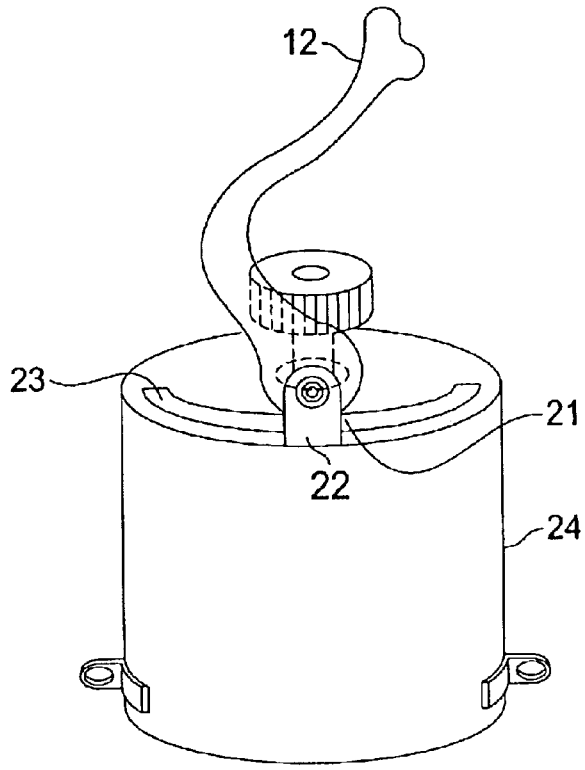
FIG. 5 is a front view of the motor and disengagement arm of the firing device of FIG. 1.

The disengagement arm 12 shown in FIG. 4 has a pivot axle 21 that rotates in a bushing mounted on an upright tab 22 extending perpendicularly up from a semi-circular ring 23 that is cemented to the end of the motor 24, as shown in FIG. 5.

With this arrangement of the components, the action of the trigger release is fully self-regulating in resetting itself and disengaging itself at the proper times. The adjustment for optimal performance can be done by cutting the link wire between the disengagement arm and the idler bracket to a specific length. This adjustment is important, an accuracy of about 1/32 inch being required.

Figure 6:
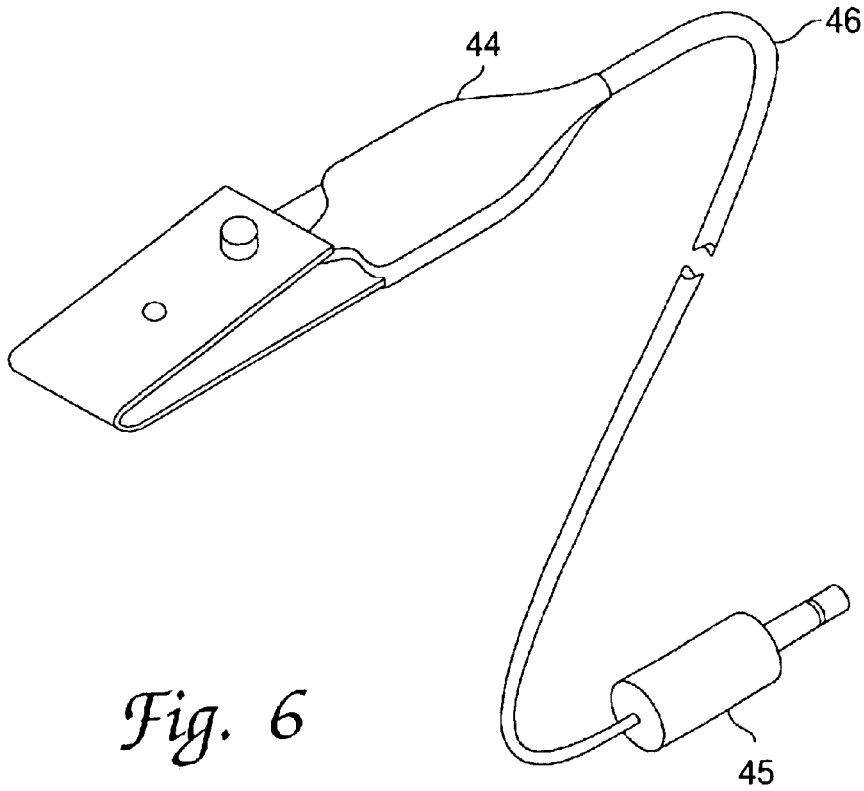
FIG. 6 is a bite contact actuator used with the firing device of FIG. 1.

The power source for this device is a packet of three AAA batteries, providing 4.5 volts operating voltage. This packet is attached to the reverse side of the mounting bracket, away from the motor and gearbox. Alternatively, the power pack may be connected by wiring of sufficient length that the relatively heavy power pack may be positioned in a users pocket or on a belt. An associated wire from the pack provides power to the motor. The leads from the battery pack go to the motor and a minisocket 26 in FIG. 2. These latter two elements are in one embodiment connected in parallel so that either closure activates the motor. This allows the user the options of activating the release either by using a hands-free switch (e.g. bite clamp switch) or using a microswitch activated by the user's fingers. As shown in FIG. 6, a wire 46 (about 36 inches long), leads to the spring contact switch 44 that the shooter places between his teeth just before drawing the bow for the shot. This contact closes the circuit between the battery and motor, actuating the gear mechanism. Using either method of activation, the trigger pulling action is quite prompt, requiring less than a half second to complete. Once the bite contact switch is closed, a signal is sent through wire 46 to miniplug 45. (See FIG. 6.)

If a microlever switch is employed, it is mounted on top of the release where it can be reached by the trigger finger, normally the index finger. Alternately it may be positioned for thumb activation or some other finger activation. As shown in FIG. 4, microswitch 50 is linked by wire 51 to motor 24. This connection is made in parallel with the bite switch, as disclosed above.

An alternative embodiment of the invention, shown in FIG. 7, again uses a conventional release aid of the type consisting of a shank with the jaw at the extreme end, a trigger in the body of the shank and a wrist strap at the other end modified for electrical actuation.

This modified device requires mounting a small 4.5 volt electric hobby motor having a reduction gear train and a free idler gear acting as a clutch mechanism to the underside of the release.

Figure 7:
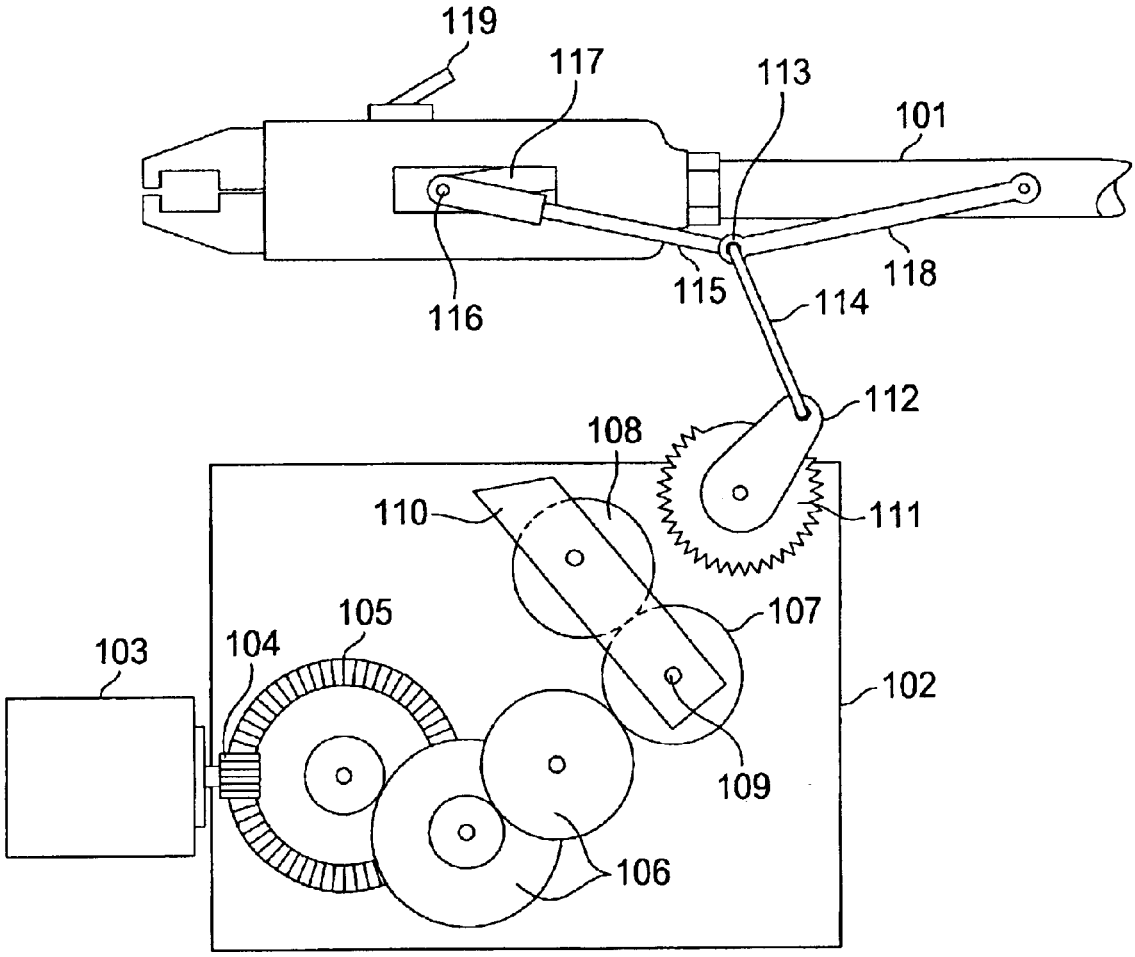
FIG. 7 is a side view of an alternative embodiment of the present invention.

In the schematic view of FIG. 7, the release body 101 has mounted below it a gear box mounting frame 102, having as components the motor 103, the pinion gear 104, the crown gear 105, several stages of reduction gears 106, a first transfer gear 107, a second transfer pivot gear 108, the latter being free to pivot about pivot bracket axle 109 while remaining in full engagement with the first transfer gear 107 through its mounting in a pivot bracket/clutch 110, and finally a final crank gear 111 having a rigidly attached crank arm 112. The teeth or gears 106, 107 and 108 are not shown. Gear 107 engages crank gear 111.

The gear box frame 102 with its above listed components is linked at link point 113 through actuating link wire 114 to a trip latch lever consisting of a primary link 115, having a ball joint 116 joining it to the release trigger 117, and a pivot link 118.

When the electric motor 103 is activated, by any means of closing its electrical circuit with a battery source, the reduction gear train 106 impels the first transfer gear 107 to rotate clockwise. This rotation of gear 107 initially imparts a clockwise swinging motion to the pivot bracket/clutch carrying with it the second transfer pivot gear 108 because of a small amount of rotational friction maintained between the first transfer gear 107 and the pivot bracket/clutch 110 by means of a small compression spring on the axle 109 of rotation. The swinging motion of the pivot bracket/clutch 110 carries it through an arc sufficient to bring second transfer pivot gear 108 into engagement with the crank gear 111, which then begins a clockwise rotation.

Crank gear 111 has a rigidly attached crank arm 112 with a pivot point for receiving the lower end of the actuating link wire 114. Rotation of crank gear 111 draws downward the link point 113 between the two connected links 115 and 118, imparting a rightward motion to the trigger 117, which then trips the release.

After the release trips, the rotation of the crank gear 111 is terminated automatically at the rotational position of farthest downward travel of the crank by virtue of the removal of several teeth of the crank gear 111 at a suitable location on its periphery. When the vacant arc-section of the crank gear 111 comes into adjacency with the second transfer pivot gear 108, it ceases to be engaged, and remains out of engagement, whether or not the motor and gear train continue to operate, until the release trigger 117 is reset to the closed position.

The trigger 117 is reset by the normal motion of pushing forward with the trigger finger, and this motion is not impeded by the linkage to the crank gear 111, because of the disengagement of the latter from the gear train. Rather, the crank gear 111 itself is simultaneously restored to position whereby its teeth are ready once more for engagement by the second transfer pivot gear 108 upon activation of the motor.

The preferred method for closing the electrical circuit between the motor and the battery source is a switch closed by biting with the teeth. Because of a tendency to bite while drawing the bow, resulting in a premature release of the arrow, it is preferred to have an additional arming switch 119 placed on the release. Upon obtaining full draw of the bow and acquiring approximate aim, the shooter can switch the arming switch to the on position, after which the release is under control of the bite switch.

The detailed description provided herein described an embodiment in which the present device is used to fire a bow. This invention is readily adaptable to mounting on the stock of a rifle so that the wind-up cord pulls the trigger in the same way as the trigger of a bowstring release. The same advantage in target shooting should result, in that the disturbance to the shooter's aim associated with the act of pulling the trigger is avoided.

A number of modifications are possible that are within the present invention. As illustrated, the switch was bite activated. However, the use could achieve the same advantage with a number of hands-free switches, such as those activated by a foot tap or other signal activated by the user and sent to a device carried by the user. In the illustrated embodiment, the hands free switch was linked by a wire to the projectile firing device. However, a number of wireless transmitters (such as in FIG. 1, a transmitter 200 sending a signal to a receiver 201 eliminating the need for wire 46) exist which could be used so that a wire connection is not needed. Such devices are presently marketed for remote control of devices.

What is claimed is:

1. An apparatus aiding in firing a projectile firing device, the apparatus comprising:

a hands-free trigger switch that may be activated by a user to send a signal; and a firing mechanism, which receives a signal from the switch and automatically fires the projectile firing devices;

wherein the projectile firing device is a bow, and the firing mechanism includes an operable law having a release trigger.

2. The apparatus of claim 1, wherein said firing mechanism includes a strap, whereby the firing mechanism may be worn on the arm of the user.

3. The apparatus of claim 1, wherein the non-digitally triggered switch is a bite-triggered switch.

4. The apparatus of claim 1, wherein the non-digitally triggered switch has a wireless connection to the firing mechanism selected from the group consisting of a radio frequency connection, an infrared light connection and a visible light connection.

5. The apparatus of claim 1, further including a hand activated switch, connected in parallel with the hands-free trigger switch such that a user may select either switch to fire the projectile firing device.

6. The apparatus of claim 1, wherein said firing mechanism includes a trip lever.

7. The apparatus of claim 1, wherein said firing mechanism includes a wind-up spindle.

8. An apparatus for firing a bow, the apparatus comprising:

a jaw configured to hold a bowstring;

a jaw trigger, wherein actuation of said trigger opens the jaw and releases the bowstring;

a motor mechanically linked to said jaw trigger, wherein activation of the motor actuates the jaw trigger; and a hands-free actuator that sends a signal to the motor, activating the motor such that when said hands-free actuator is actuated, the electrical signal activates the motor, which actuates the jaw trigger thereby opening the jaws and firing an arrow held in the bowstring.

9. The apparatus of claim 8, wherein the hands-free actuator is a teeth clamp switch.

10. The apparatus of claim 8, wherein the hands-free actuator that sends a signal is selected from a group of signals consisting of a radio frequency signal, an infrared signal, and an visible light signal to the motor.

11. The apparatus of claim 8, wherein said jaw, said jaw trigger and said motor are part of a unitary structure, said structure including a wrist strap.

12. The apparatus of claim 8, further including a hand activated switch, connected in parallel with the hands-free actuator such that a user may select either switch to fire the projectile firing device.

13. The apparatus of claim 8, wherein the motor is mechanically linked to the jaw trigger by a trip lever.

14. The apparatus of claim 8, wherein the motor is mechanically linked to the jaw trigger by a wind-up spindle.

* * * * *

UNITED STATES PATENT AND TRADEMARK OFFICE

CERTIFICATE OF CORRECTION

PATENT NO. : 6,766,794 B1
DATED : July 27, 2004
INVENTOR(S) : Samuel Bayne Bentley It is certified that error appears in the above-identified patent and that said Letters Patent is hereby corrected as shown below:

Title page,
Item [12] "Bently" should read -- Bentley --.
Item [76], Inventor, "Samuel Bayne Bently" should read -- Samuel Bayne Bentley --.

Column 7,
Line 33, "devices" should read -- device --.
Line 36, "operable law" should read -- operable jaw --.

Signed and Sealed this

Twenty-second Day of February, 2005

JON W. DUDAS
*Director of the United States Patent and Trademark Office*